US008814628B2

(12) United States Patent
O'Connor et al.

(10) Patent No.: US 8,814,628 B2
(45) Date of Patent: Aug. 26, 2014

(54) TOY VEHICLE TRACK SET

(75) Inventors: Stacy Lynn O'Connor, Long Beach, CA (US); Michael Nuttall, South Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 367 days.

(21) Appl. No.: 13/117,832

(22) Filed: May 27, 2011

(65) Prior Publication Data

US 2011/0294396 A1 Dec. 1, 2011

Related U.S. Application Data

(60) Provisional application No. 61/349,501, filed on May 28, 2010.

(51) Int. Cl.
*A63H 18/00* (2006.01)
*A63H 18/02* (2006.01)

(52) U.S. Cl.
CPC ..... *A63H 18/02* (2013.01); *A63H 18/023* (2013.01)
USPC ..... 446/444; 446/435; 463/63

(58) Field of Classification Search
USPC ..... 446/429, 444, 431, 435, 437, 445; 463/63, 64, 68, 69
See application file for complete search history.

(56) References Cited

U.S. PATENT DOCUMENTS 2,211,220 A 8/1940 Verplanck
3,402,503 A 9/1968 Glass et al.
3,456,596 A * 7/1969 Cooper ..... 104/60
3,589,063 A 6/1971 Genin
3,590,524 A 7/1971 Beny et al.
(Continued)

FOREIGN PATENT DOCUMENTS

GB 2049446 A 12/1980
GB 2063084 A 6/1981
(Continued)

*Primary Examiner* — Gene Kim
*Assistant Examiner* — Joseph B Baldori
(74) *Attorney, Agent, or Firm* — Cantor Colburn LLP

(57) ABSTRACT

A toy track set for a toy vehicle is disclosed herein, the toy track set having: a first track path comprising a first looped vehicle path; a second track path comprising an alternate vehicle path, the second track path having a first segment and a second segment, the second segment being separated from the first segment by a gap, the second segment being pivotally mounted to the track set for reciprocal movement between a first position and a second position, wherein a toy vehicle travelling along the second track path from the first segment to the second segment will travel along a first portion of the second segment when the second segment is in the first position and the toy vehicle traverses the gap and wherein the toy vehicle travelling along the second track path from the first segment to the second segment will be captured in a receiving area of the second segment when the second segment is in the second position and the toy vehicle traverses the gap; a track diverter pivotally mounted to the track set for movement between a first position and a second position wherein the toy vehicle travelling along the first track path will remain on the first track path when the track diverter is in the first position and wherein the toy vehicle travelling along the first track path will be diverted to the second track path when the track diverter is in the second position; and a booster for propelling the toy vehicle along either the first track path or the second track path.

20 Claims, 5 Drawing Sheets

(56) References Cited

U.S. PATENT DOCUMENTS

| | | | | |
|---|---|---|---|---|
| 3,621,602 | A | 11/1971 | Barcus et al. | |
| 3,630,524 | A | 12/1971 | Cooper et al. | |
| 3,636,651 | A | 1/1972 | Lohr et al. | |
| 3,641,704 | A | 2/1972 | Sims et al. | |
| 3,775,897 | A | 12/1973 | Soulakis et al. | |
| 3,818,628 | A | 6/1974 | Ensmann et al. | |
| 3,858,875 | A | 1/1975 | Nemeth et al. | |
| 3,860,237 | A | 1/1975 | Cooper et al. | |
| 3,908,989 | A | 9/1975 | Meyer | |
| 4,070,024 | A | 1/1978 | Hamano | |
| 4,094,089 | A | 6/1978 | Sano | |
| 4,185,409 | A | 1/1980 | Cheng | |
| 4,249,733 | A | 2/1981 | Eddins et al. | |
| 4,290,605 | A | 9/1981 | Matsumoto | |
| 4,355,807 | A | 10/1982 | Prehodka | |
| 4,357,778 | A | 11/1982 | Matsumoto et al. | |
| 4,383,688 | A | 5/1983 | Prehodka | |
| 4,394,961 | A | 7/1983 | Muller | |
| 4,513,966 | A | 4/1985 | Mucaro et al. | |
| 4,519,789 | A | 5/1985 | Halford et al. | |
| 4,558,867 | A | 12/1985 | Hippely | |
| 4,564,197 | A * | 1/1986 | Lambert et al. | 463/64 |
| 4,708,685 | A | 11/1987 | Udagawa | |
| 4,715,843 | A | 12/1987 | Ostendorff et al. | |
| 4,767,053 | A | 8/1988 | Cook et al. | |
| 4,932,917 | A | 6/1990 | Klitsner | |
| 4,938,481 | A | 7/1990 | Goldfarb et al. | |
| 4,961,716 | A * | 10/1990 | Hippely et al. | 446/75 |
| 5,087,001 | A | 2/1992 | Bolli et al. | |
| 5,102,133 | A | 4/1992 | Chilton et al. | |
| 5,174,569 | A | 12/1992 | Ngai | |
| 5,203,559 | A | 4/1993 | Goldfarb | |
| 5,205,554 | A | 4/1993 | Copson | |
| 5,234,216 | A * | 8/1993 | Ostendorff | 273/127 A |
| 5,254,030 | A * | 10/1993 | Ostendorff et al. | 446/430 |
| 5,299,969 | A | 4/1994 | Zaruba | |
| 5,440,996 | A | 8/1995 | Cottino | |
| 5,542,668 | A | 8/1996 | Casale et al. | |
| 5,586,923 | A * | 12/1996 | Hippely et al. | 446/14 |
| 5,735,724 | A | 4/1998 | Udagawa | |
| 5,767,655 | A | 6/1998 | Ostendorff et al. | |
| 5,899,789 | A | 5/1999 | Rehkemper et al. | |
| 6,089,951 | A | 7/2000 | Ostendorff | |
| 6,164,653 | A | 12/2000 | Chuang | |
| 6,241,573 | B1 | 6/2001 | Ostendorff et al. | |
| 6,358,112 | B1 | 3/2002 | Lambert et al. | |
| 6,406,350 | B2 * | 6/2002 | Yoneda et al. | 446/423 |
| 6,478,654 | B1 | 11/2002 | Rehkemper et al. | |
| 6,508,179 | B2 | 1/2003 | Annis et al. | |
| 6,517,007 | B2 | 2/2003 | Kong | |
| 6,676,480 | B2 | 1/2004 | Sheltman | |
| 6,695,675 | B1 | 2/2004 | Ngan | |
| 6,783,419 | B1 | 8/2004 | Paukert et al. | |
| 6,793,554 | B1 | 9/2004 | Newbold | |
| 6,852,000 | B2 | 2/2005 | Lee et al. | |
| 6,951,497 | B1 | 10/2005 | Ngan | |
| 7,017,912 | B2 | 3/2006 | Chiang | |
| 7,070,541 | B2 | 7/2006 | Madigan et al. | |
| 7,354,006 | B1 | 4/2008 | Bricker | |
| 7,537,509 | B2 | 5/2009 | Payne et al. | |
| 7,549,906 | B2 | 6/2009 | Bedford et al. | |
| 7,628,674 | B2 * | 12/2009 | Nuttall et al. | 446/444 |
| 7,690,964 | B2 * | 4/2010 | Nuttall et al. | 446/444 |
| 7,794,301 | B2 * | 9/2010 | Ostendorff et al. | 446/429 |
| 7,819,720 | B2 * | 10/2010 | Nuttall et al. | 446/444 |
| 8,182,308 | B2 * | 5/2012 | Payne | 446/267 |
| 8,267,738 | B2 * | 9/2012 | Nuttall | 446/444 |
| 8,323,069 | B2 * | 12/2012 | Nuttall et al. | 446/444 |
| 2003/0224697 | A1 | 12/2003 | Sheltman et al. | |
| 2005/0191940 | A1 | 9/2005 | Sheltman et al. | |
| 2005/0287915 | A1 | 12/2005 | Sheltman et al. | |
| 2005/0287918 | A1 | 12/2005 | Sheltman et al. | |
| 2005/0287919 | A1 | 12/2005 | Sheltman et al. | |
| 2006/0141902 | A1 | 6/2006 | Sinisi | |
| 2006/0286896 | A1 | 12/2006 | Bedford et al. | |
| 2007/0149090 | A1 | 6/2007 | Hippely | |
| 2007/0197127 | A1 | 8/2007 | Ostendorff et al. | |
| 2007/0293123 | A1 | 12/2007 | Nuttall et al. | |
| 2008/0009224 | A1 | 1/2008 | Nuttall et al. | |
| 2008/0020675 | A1 | 1/2008 | Ostendorff | |
| 2008/0070474 | A1 | 3/2008 | Nuttall | |
| 2008/0113585 | A1 * | 5/2008 | Payne et al. | 446/444 |
| 2008/0242193 | A1 | 10/2008 | Filoseta et al. | |
| 2008/0268743 | A1 | 10/2008 | O'Connor et al. | |
| 2009/0075558 | A1 | 3/2009 | Ostendorff | |
| 2009/0130946 | A1 | 5/2009 | Fink et al. | |
| 2011/0021111 | A1 * | 1/2011 | Nuttall et al. | 446/444 |
| 2011/0244755 | A1 * | 10/2011 | Nuttall et al. | 446/153 |
| 2011/0294396 | A1 * | 12/2011 | O'Connor et al. | 446/444 |
| 2012/0164914 | A1 * | 6/2012 | O'Connor et al. | 446/444 |
| 2012/0220183 | A1 * | 8/2012 | Payne | 446/14 |
| 2012/0322342 | A1 * | 12/2012 | De La Torre | 446/444 |

FOREIGN PATENT DOCUMENTS

| | | | |
|---|---|---|---|
| GB | 2187651 | A | 9/1987 |
| GB | 2293556 | A | 4/1996 |
| WO | 9949948 | | 10/1999 |
| WO | 2007056482 | A2 | 5/2007 |
| WO | 2007131204 | A2 | 11/2007 |
| WO | 2007146241 | A2 | 12/2007 |

* cited by examiner

TOY VEHICLE TRACK SET

CROSS REFERENCE TO RELATED APPLICATIONS

This application claims the benefit of U.S. Provisional Patent Application No. 61/349,501 filed May 28, 2010 the contents of which are incorporated herein by reference thereto.

BACKGROUND

Play sets for toy vehicles are popular toys which are known to provide entertainment and excitement to a user. These play sets typically include a track configuration intended to guide a propelled toy vehicle, such as a 1/64 scale die-cast metal toy vehicle, through a course. The track configurations include closed-loop continuous track arrangements and open-end arrangements. Toy vehicles are placed on these play set tracks and propelled across the configuration by hand or by an external propulsion means.

To bring increased entertainment and excitement to play sets, track configurations may include features such as intersecting tracks, loop segments, and other types of track configurations known in the art.

Accordingly, a play set for toy vehicles is desired which can provide the entertainment and excitement of a toy vehicle launched from a track and which also includes provisions for variations in the outcome of the vehicle travelling along the track.

BRIEF SUMMARY OF INVENTION

In one exemplary embodiment a toy track set for a toy vehicle is provided, the toy track set having: a first track path comprising a first looped vehicle path; a second track path comprising an alternate vehicle path, the second track path having a first segment and a second segment, the second segment being separated from the first segment by a gap, the second segment being pivotally mounted to the track set for reciprocal movement between a first position and a second position, wherein a toy vehicle travelling along the second track path from the first segment to the second segment will travel along a first portion of the second segment when the second segment is in the first position and the toy vehicle traverses the gap and wherein the toy vehicle travelling along the second track path from the first segment to the second segment will be captured in a receiving area of the second segment when the second segment is in the second position and the toy vehicle traverses the gap; a track diverter pivotally mounted to the track set for movement between a first position and a second position wherein the toy vehicle travelling along the first track path will remain on the first track path when the track diverter is in the first position and wherein the toy vehicle travelling along the first track path will be diverted to the second track path when the track diverter is in the second position; and a booster for propelling the toy vehicle along either the first track path or the second track path.

In another exemplary embodiment, a method of providing various track paths in a toy track set for a toy vehicle is provided, the method including the steps of: propelling a toy vehicle along a first track path comprising a first looped vehicle path; and diverting the toy vehicle from the first track path to a second track path with a track diverter pivotally mounted to the track set for movement between a first position and a second position wherein the toy vehicle travelling along the first track path will remain on the first track path when the track diverter is in the first position and wherein the toy vehicle travelling along the first track path will be diverted to the second track path when the track diverter is in the second position and wherein the second track path comprises an alternative vehicle path, the second track path having a first segment and a second segment, the second segment being separated from the first segment by a gap, the second segment being pivotally mounted to the track set for reciprocal movement between a first position and a second position, wherein the toy vehicle travelling along the second track path from the first segment to the second segment will travel along a first portion of the second segment when the second segment is in the first position and the toy vehicle traverses the gap and wherein the toy vehicle travelling along the second track path from the first segment to the second segment will be captured in a receiving area of the second segment when the second segment is in the second position and the toy vehicle traverses the gap.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 8:
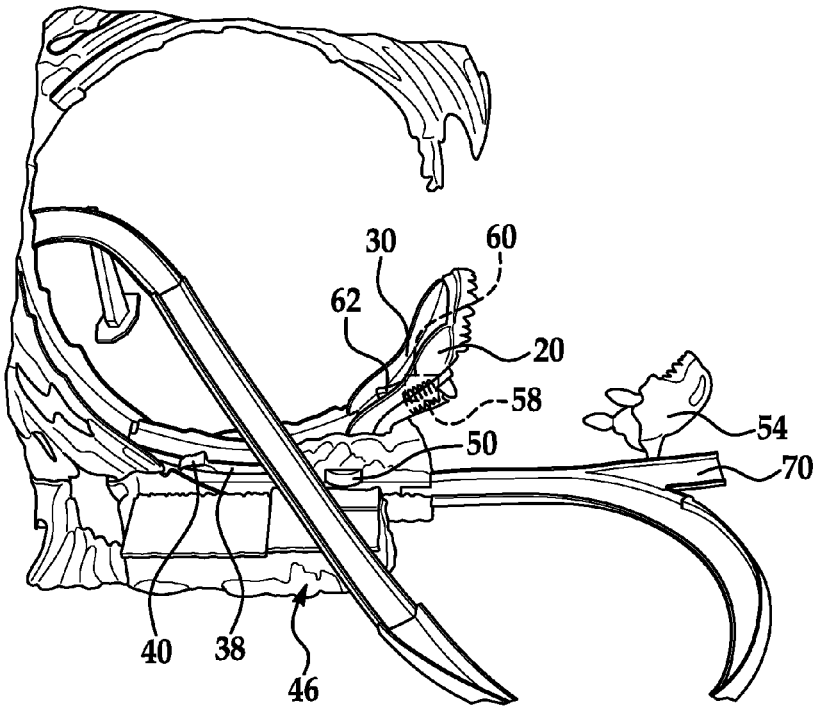
FIGS. 8 and 9 illustrate portions of the toy track set illustrated in FIGS. 3 and 4.
Figure 9:
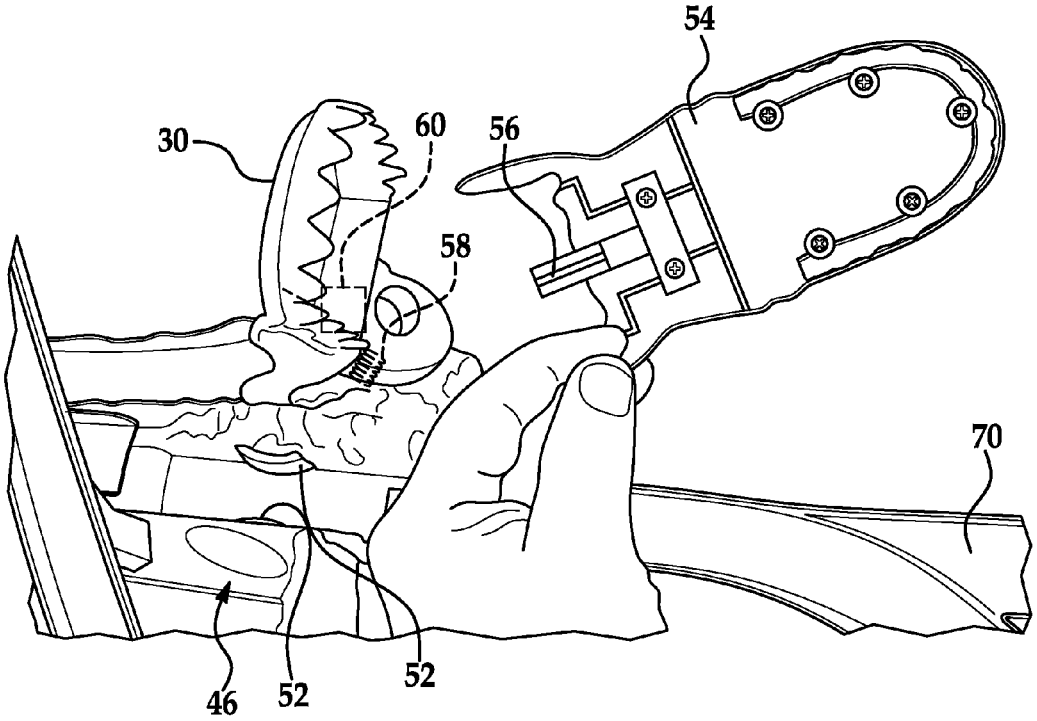

Referring now to the attached FIGS. an exemplary embodiment of a toy track set 10 for toy vehicles 12 is illustrated. In one embodiment, the toy vehicles ride on wheels disposed in contact with the tracks or portions of the toy track set. The toy track set includes a first track path 14 comprising a first looped or continuous vehicle path and a second track path 16 comprising an alternate vehicle path, which may include a portion of the first track path. The first track path will comprises a plurality of track segments secured to each other to define the first looped vehicle path, which in one exemplary embodiment may resemble a "Figure-8" track path wherein one section is elevated from another section so that the toy vehicles can traverse above and below the corresponding track sections and continuously along the first track path.

The second track path will have a first segment 18 and a second segment 20, the second segment being separated from the first segment by a gap 22. In one non-limiting exemplary embodiment, the first segment will define a portion of a loop (e.g., a continuously upwardly sloping section of track) such that the toy vehicle is inverted prior to it leaving the first track segment and traversing the gap. The second segment will in some instances provide a path back to the first track path.

Figure 1:
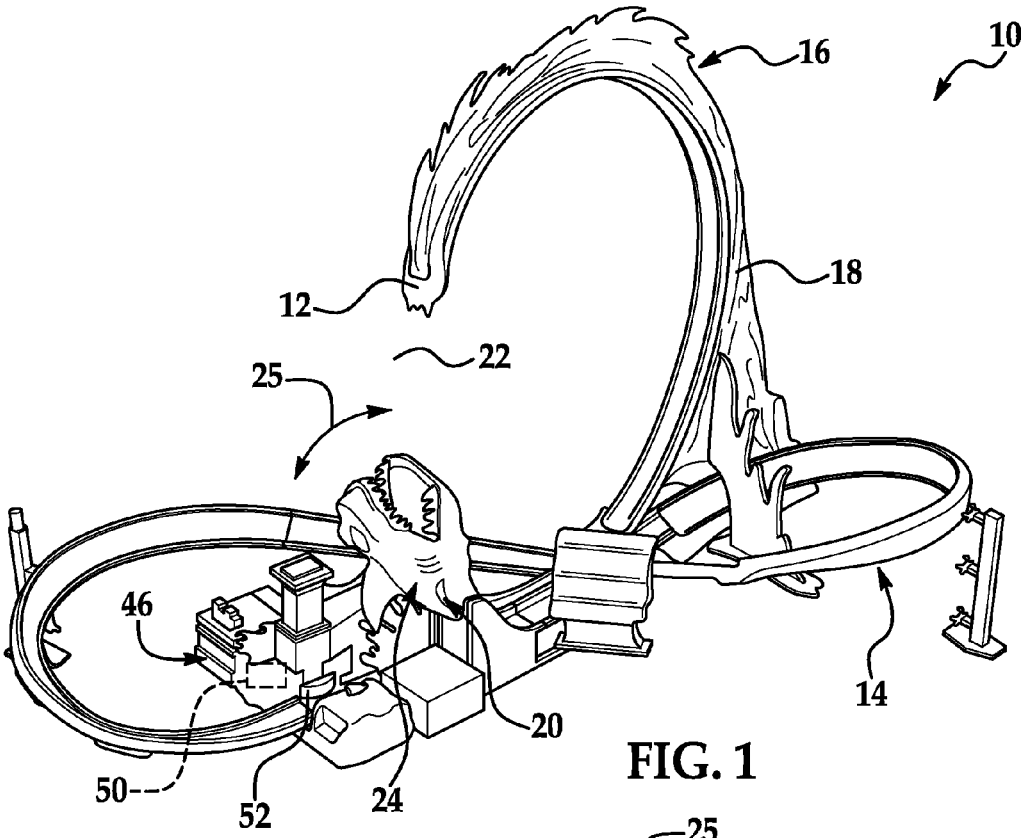
FIGS. 1 and 2 are perspective views of a toy track set in accordance with one exemplary embodiment of the present invention.
Figure 2:
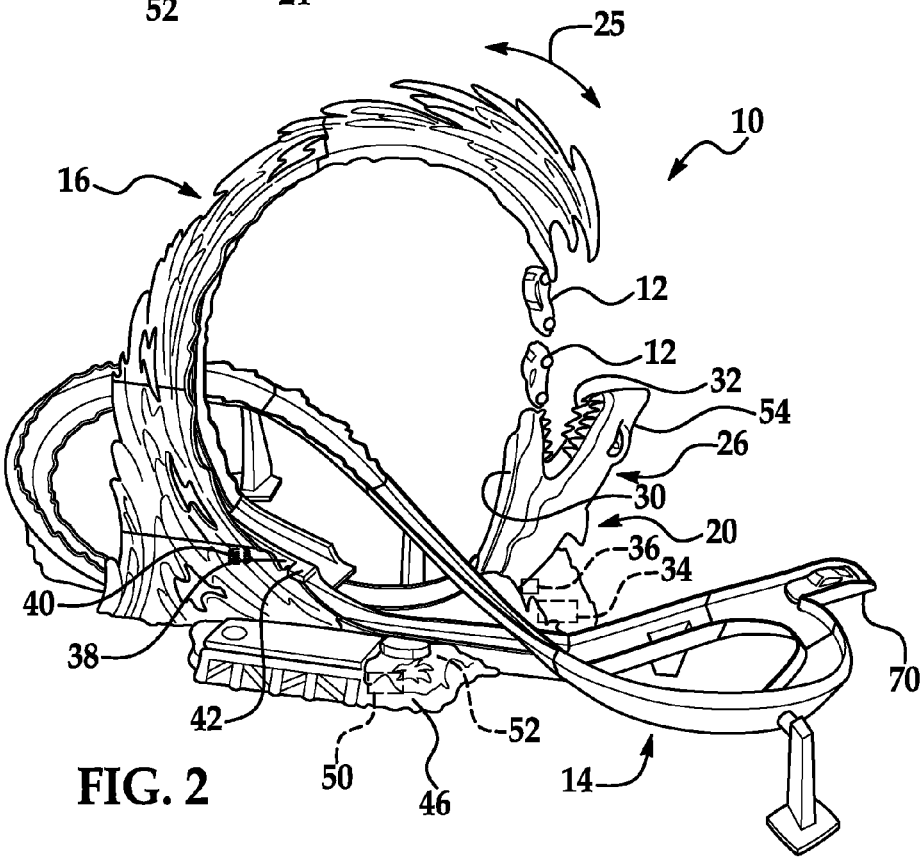
Figure 3:
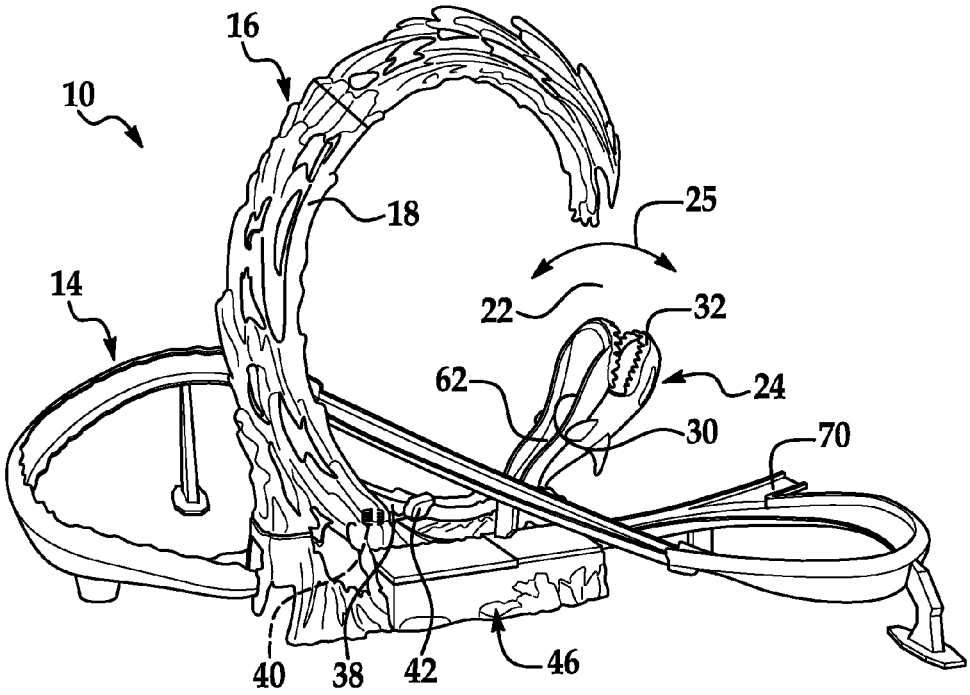
FIGS. 3 and 4 are perspective views of a toy track set in accordance with another exemplary embodiment of the present invention.
Figure 4:
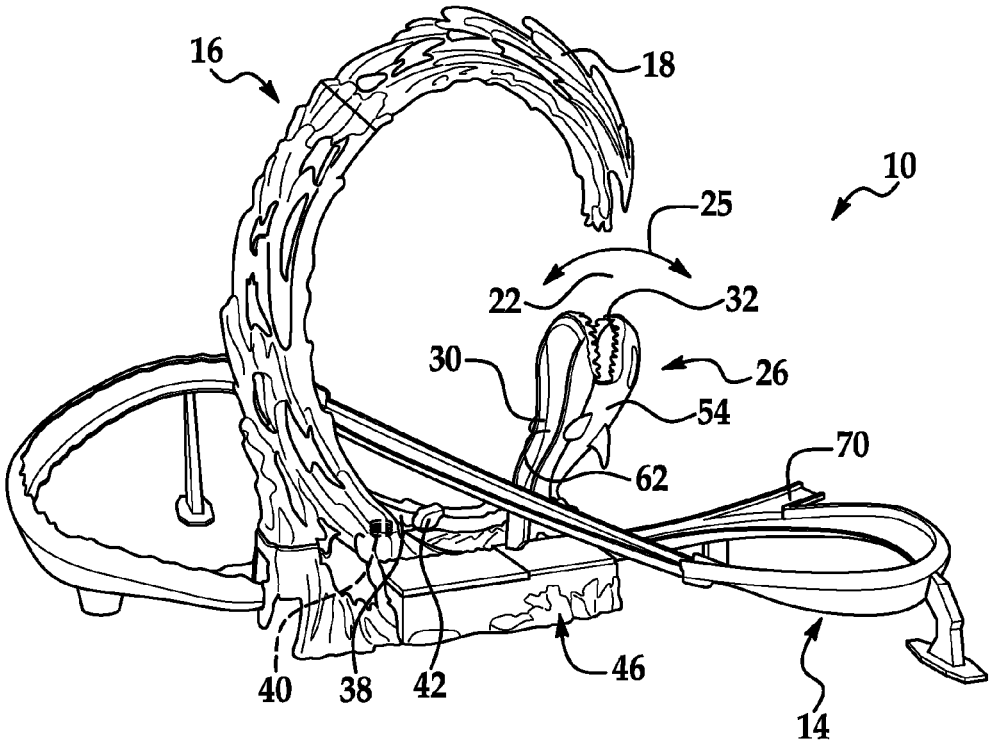

In accordance with an exemplary embodiment of the present invention, the second segment will be pivotally or movably mounted to the track set for reciprocal movement in the direction of arrows 25 between a first position 24 illustrated at least in FIGS. 1 and 3 and a second position 26 illustrated at least in FIGS. 2 and 4. The second segment and the first segment are configured such that when a toy vehicle is travelling along the second track path from the first segment to the second segment the toy will travel along a first portion 30 or smooth bottom portion 30 located on an underside or exterior surface of the second segment when the second segment is in the first position and the toy vehicle traverses the gap. The first portion or smooth bottom 30 provides a path back into the first track path.

Alternatively and when the toy vehicle is travelling along the second track path from the first segment to the second segment the toy will be captured in a receiving area 32 of the second segment when the second segment is in the second position and the toy vehicle traverses the gap. Of course, positions of the second segment 20 between the first position 24 and the second position 26 are contemplated and such positions may cause vehicles to contact the second segment and be deflected away from the track paths.

In one exemplary embodiment, a motor 34 is coupled to the second segment via a linkage 36 such that the motor when energized will cause the reciprocal movement of the second segment back and forth between the first and second positions and in the directions of arrows 25. For example, motor 34 will a portion of the linkage such that movement in the direction of arrows 25 is achieved. In one embodiment and referring to FIG. 2A, the motor 34 is coupled to a gear box 27 in order to impart rotational movement to a cam 29 in the direction of arrows 31. An exterior surface 33 of cam 29 makes contact with a pin or feature 35 coupled to the second segment which is pivotally mounted to the track set such that as cam 31 is rotated the pin or feature 35 engages surface 33 of the cam and will cause complementary movement of the second segment 20 in the direction of arrows 25. As illustrated, the exterior surface 33 of the cam is varied such that at least three ranges of movement back and forth between the first position 24 and the second position 26 are provided in order to provide random movement of the second segment 20.

For example, a first range movement may be from the first position 24 to a first distance, which is less than the distance to the second position 26 and back to the first position 24. A second range of movement will be from the first position 24 to a second distance, which is greater than the first distance, but is still less than the distance to the second position 26 and back to the first position. Still further, a third range of movement will be from the first position 24 to a third distance, which is the distance from the first position to the second position and back to the first position. Accordingly, the configuration of the exterior surface 33 can provide varying ranges of movement such that the second segment does not allow movement of the second segment from the first position to the second position, which in turn may trick a user into thinking the second segment will be in the second position to allow the toy vehicle to be captured in the second segment or alternatively trick the user into when the second segment will be in the first position to allow the vehicle to completely travel along the second track path without being captured or deflected by the second segment.

Figure 2A:
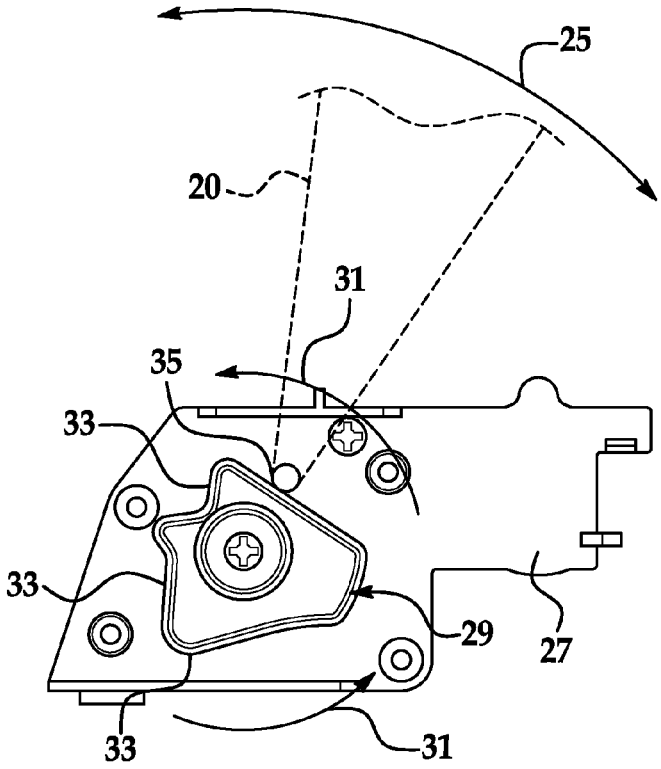
FIG. 2A illustrates portions of a mechanism for moving a segment of a track path of the toy track set.

In other words, by providing different ranges of movement the second segment may take a longer or shorter time period to move from the first position and back again. Of course, numerous variations are contemplated and the cam illustrated in FIG. 2A is merely an example of cam configured to provide various ranges of movement.

In addition and in one alternative embodiment, the second segment is spring biased into the first position by a spring 37 coupled to the second segment 20 at one end and a portion of the track set at another end such that as cam 33 rotates and depending on the configuration of the surface 33 the second segment will be pulled towards the first position by spring 37. Alternatively, the spring 37 may bias the second segment 20 into the second position. Of course, other variations with or without a spring biasing force are contemplated to be with the scope of various embodiments of the present invention.

Figure 7:
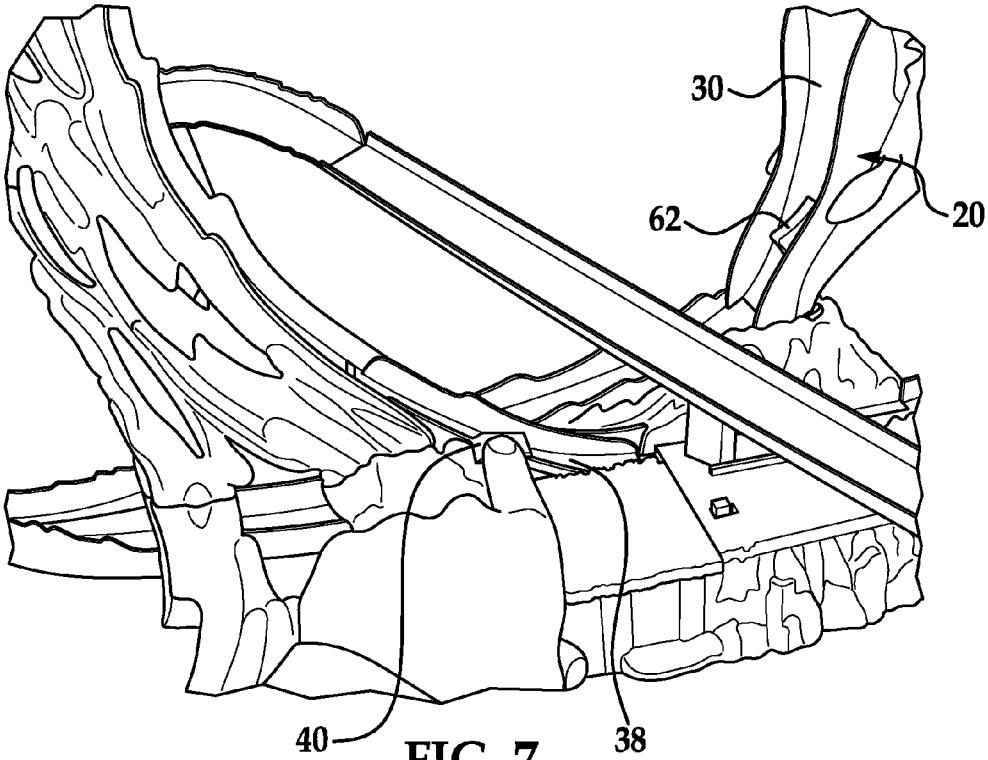

In order to divert vehicles travelling along the first track path towards the second track path, a track diverter 38 is pivotally mounted to the track set for movement between a first position (See at least FIG. 2) wherein a distal end of the track diverter is elevated from a portion of the first track path such that a toy vehicle will travel underneath the track diverter and remain on the first track path and a second position (See at least FIG. 7) wherein the distal end of the track diverter is aligned or flush with a portion of the first track path such that a toy vehicle travelling along the first track path will be diverted to the second track path when the track diverter is in the second position.

In one exemplary embodiment, the track diverter is spring biased into the first position by a spring 40 and the track diverter has a tab or handle portion 42 for a user to depress the track diverter into the second position thus, the user can select or time when the toy vehicle should travel onto the second track path without being captured in the receiving area or alternatively the user can try and have the toy vehicle captured in the receiving area by watching the reciprocal movement of the second segment and timing the movement of the track diverter.

Figure 5:
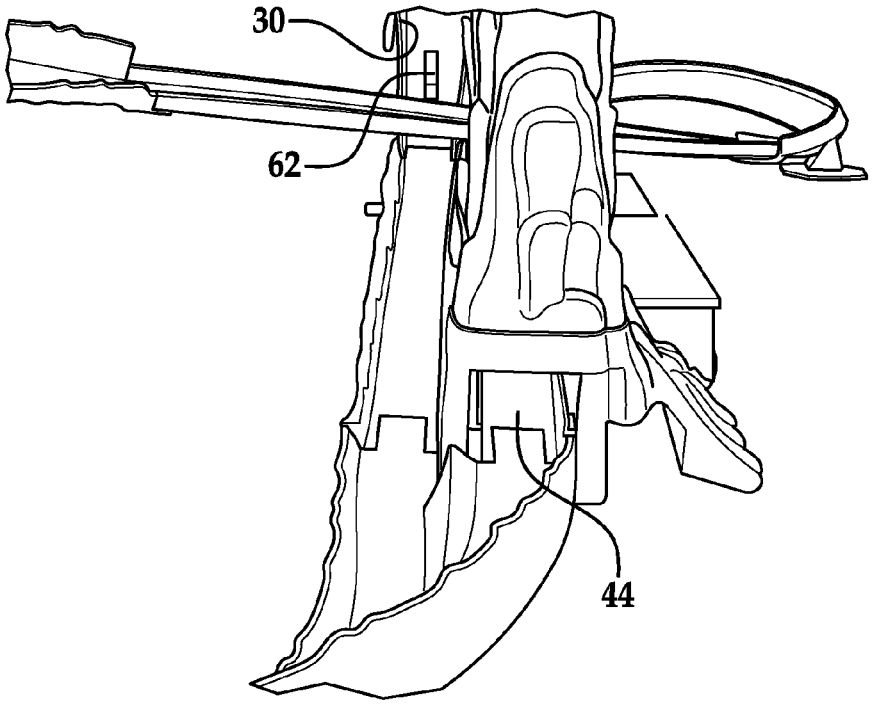
FIGS. 5-7 are additional view of the toy track set illustrated in FIGS. 3 and 4.
Figure 6:
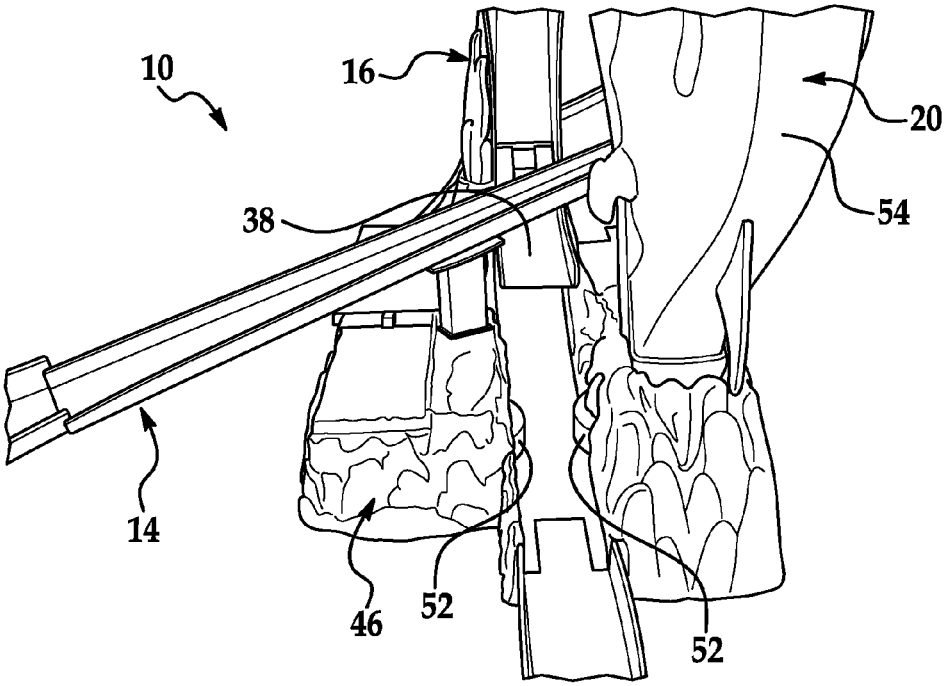

FIG. 5 illustrates one non-limiting exemplary embodiment, wherein a portion 44 of the first track path is below the track diverter as well as the first portion 30 of the second segment such that toy vehicles travelling along either one of these paths will cause them to remain on the first track path until the track diverter is moved to the second position.

In one embodiment and in order to propel the toy vehicles along the toy track set a booster 46 is provided for propelling the toy vehicle along either the first track path or the second track path. As is known in the related arts the booster is configured to accelerate the toy vehicles along the tracks of the toy. In one non-limiting embodiment, the booster is powered by a motor 50 that is coupled to one or more booster wheels 52 that are each arranged in one of the track paths. The booster wheels may be made of rubber (PVC), foam, or other materials known in the art. In one embodiment, a single wheel may be employed or two oppositely disposed wheels are employed. The motor, which may be a 6-volt electric motor, rotates the booster wheels at high speeds such that vehicles travel along the track path contact the rotating wheels and are propelled forward thereby at higher speeds to ensure the return of the vehicles to the inlet of the booster wheels after one of the track paths is traversed. As such, vehicles traveling through the track set may traverse along the first track path or through the second track path through anyone of a loop and other stunt features as long as the booster is operated or until the vehicle is captured in the receiving area.

In one embodiment, the second segment has a portion 54 releasably secured thereto for launching of the portion 54 from the second segment. Here the portion has a feature 56 for compressing a spring 58 in the second segment and a releasable catch 60 engages a portion of the feature when the feature compresses the spring and the portion is secured to the second segment.

In order to release the portion and the compressed energy of the spring a trigger 62 for releasing the releasable catch is positioned on the first portion of the second segment such that when the toy vehicle travels along the first portion of the second segment the trigger is depressed by the vehicle and the portion is launched from the second segment by the spring. Accordingly, the trigger is movably mounted in the path defined by the first portion of the second segment. It is, of course, understood that any suitable trigger and release mechanism may be employed by exemplary embodiments of the present invention as long as the portion is launched from the second segment when the trigger is depressed by a vehicle traveling along the first portion of the second segment. In an alternative embodiment, the releasable catch is configured to only release the releasable portion 54 after the trigger is actuated a predetermined number of times (e.g., the trigger needs to be actuated three times before the portion is released). Of course, a releasable catch that is actuated by a single trigger movement is also contemplated.

Accordingly enhanced play is provided such that a user may time the diverting of the toy vehicle into the second track path such that actuation of the trigger occurs and the portion is launched from the second segment. In addition and in another embodiment, the portion defines a portion of the receiving area and vehicles previously captured in the receiving area 32 can be released when the trigger is depressed and the portion is launched. Accordingly, numerous options are available wherein the user may time the movement of the second segment to either be captured or pass safely by the second segment. Still further, the second segment will have random movement between two extreme positions (e.g., one for capture and one for bypass) and an alternative trigger can be provided to launch a portion of the second segment which in one alternative embodiment may release captured objects as the portion being launched comprises a portion of a capturing area of the second segment.

As illustrated in the FIGS and in non-limiting exemplary embodiments, the second segment is configured to resemble a creature such as a shark or whale (e.g., killer whale) and the releasable portion defines one half of the jaw of the creature and the track set have a water or sea theme wherein a portion of the second track path resembles a wave directed towards the mouth of the creature. In this embodiment, the first segment defines at least one half of a loop resembling a wave such that the toy vehicle is inverted prior to it traversing the gap.

Accordingly and in one embodiment a method for providing various track paths in a toy track set for a toy vehicle is provided. Here a toy vehicle or vehicles are propelled along a first track path defining a first looped vehicle path such that toy vehicles will remain on the first track path until they are diverted from the first track path to a second track path with a track diverter pivotally mounted to the track set for movement between a first position and a second position.

In various embodiments and when a toy vehicle is travelling along the first track path it will remain on the first track path when the track diverter is in the first position and toy vehicles travelling along the first track path will be diverted to the second track path when the track diverter is in the second position wherein the second track path comprises an alternative vehicle path. The second track path has a first segment and a second segment, the second segment being separated from the first segment by a gap and the second segment is pivotally mounted to the track set for reciprocal movement between a first position and a second position to add enhanced play to the track set such that when a toy vehicle travelling along the second track path from the first segment to the second segment it will travel along a first portion of the second segment when the second segment is in the first position and the toy vehicle traverses the gap, which in one embodiment will cause actuation of a trigger to launch a portion of the second segment away from the second segment.

In addition and when second segment is in a second position a toy vehicle and travelling along the second track path from the first segment to the second segment it will be captured in a receiving area of the second segment when the second segment is in the second position and the toy vehicle traverses the gap. Still further, other ranges of movement between the first position and the second position are provided to provide for enhanced play patterns.

In still one other alternative embodiment the first track path is configured to have an inlet track segment 70 having one end elevated from the first track path such that additional toy vehicles or one toy vehicle may be pushed or propelled into the first track segment and received by the booster and remain on the first track segment (e.g., due to the configuration or elevation of the inlet track segment) until the diverter is moved to the second position. Accordingly, numerous vehicles can travel along different portions of the track set at the same time.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

The invention claimed is:

1. A toy track set for a toy vehicle, comprising:

a first track path comprising a first looped vehicle path;

a second track path comprising an alternate vehicle path, the second track path having a first segment and a second segment, the second segment being separated from the first segment by a gap, the second segment being pivotally mounted to the track set for reciprocal movement between a first position and a second position, wherein a toy vehicle travelling along the second track path from the first segment to the second segment will travel along a first portion of the second segment when the second segment is in the first position and the toy vehicle traverses the gap and wherein the toy vehicle travelling along the second track path from the first segment to the second segment will be captured in a receiving area of the second segment when the second segment is in the second position and the toy vehicle traverses the gap;

a track diverter pivotally mounted to the track set for movement between a first position and a second position, wherein the track diverter is a portion of the second track path and a distal end of the track diverter is elevated from a portion of the first track path such that the toy vehicle will travel underneath the track diverter and remain on the first track path when the track diverter is in its first position and wherein the distal end of the track diverter is aligned with the first track path when the distal end is in its second position such that the toy vehicle travelling along the first track path will be diverted to the second track path when the track diverter is in the second position; and a booster for propelling the toy vehicle along either the first track path or the second track path.

2. The toy track set as in claim 1, further comprising a motor for pivoting the second segment between its first position and its second position and wherein the first portion of the second segment is an exterior surface of the second segment and wherein the toy vehicle will be directed towards the track diverter when the toy vehicle travels along the exterior surface of the second segment.

3. The toy track set as in claim 1, wherein the second segment has a portion releasably secured thereto and wherein the first portion of the second segment has a trigger for releasing the releasably secured portion of the second segment when the toy vehicle travels along the first portion of the second segment.

4. The toy track set as in claim 1, wherein the first segment defines at least one half of a loop such that the toy vehicle is inverted prior to it traversing the gap.

5. The toy track set as in claim 3, wherein the releasably secured portion of the second segment defines a portion of the receiving area.

6. The toy track set as in claim 5, wherein the releasably secured portion of the second segment has a feature for compressing a spring in the second segment when the releasably secured portion is releasably secured to the second segment and a releasable catch engages the feature when the feature compresses the spring and the trigger releases the releasable catch when the toy vehicle travels along the first portion of the second segment and the releasably secured portion is launched from the second segment by the spring.

7. The toy track set as in claim 6, further comprising a motor for pivoting the second segment between its first position and its second position.

8. The toy track set as in claim 7, wherein the track diverter is spring biased into its first position.

9. The toy track set as in claim 1, wherein the track diverter is spring biased into its first position and the toy track set further comprising a motor for pivoting the second segment between its first position and its second position, wherein the motor rotates a cam configured to provide at least two different ranges of movement of the second segment as the second segment moves between its first position and its second position.

10. The toy track set as in claim 1, wherein the second segment resembles a creature and wherein the second segment has a portion releasably secured thereto, the releasably secured portion resembling portions of a jaw of the creature and wherein the first portion of the second segment has a trigger for releasing the releasably secured portion when the toy vehicle travels along the first portion of the second segment.

11. The toy track set as in claim 10, further comprising a motor for pivoting the second segment between its first position and its second position.

12. The toy track set as in claim 10, wherein the releasably secured portion of the second segment defines a portion of the receiving area.

13. The toy track set as in claim 12, wherein the releasably secured portion of the second segment has a feature for compressing a spring in the second segment when the releasably secured portion is releasably secured to the second segment and a releasable catch engages the feature when the feature compresses the spring and the trigger releases the releasable catch when the toy vehicle travels along the first portion of the second segment and the releasably secured portion is launched from the second segment by the spring.

14. The toy track set as in claim 13, further comprising a motor for pivoting the second segment between its first position and its second position.

15. The toy track set as in claim 13, wherein the track diverter is spring biased into its first position.

16. A toy track set having various track paths for a toy vehicle, the toy track set comprising:

a first track path having a first looped path; and a track diverter for diverting the toy vehicle from the first track path to a second track path, wherein the track diverter is pivotally mounted to the track set for movement between a first position and a second position wherein the toy vehicle travelling along the first track path will remain on the first track path when the track diverter is in the first position and wherein the toy vehicle travelling along the first track path will be diverted to the second track path when the track diverter is in the second position and wherein the second track path further comprises an alternative vehicle path, the second track path having a first segment and a second segment, the second segment being separated from the first segment by a gap and the second segment is pivotally mounted to the track set for reciprocal movement between a first position and a second position, wherein the toy vehicle travelling along the second track path from the first segment to the second segment will travel along a first portion of the second segment when the second segment is in its first position and the toy vehicle traverses the gap and wherein the toy vehicle travelling along the second track path from the first segment to the second segment will be captured in a receiving area of the second segment when the second segment is in its second position and the toy vehicle traverses the gap, wherein the first portion of the second segment is an exterior surface of the second segment and wherein the toy vehicle will be returned to the track diverter when the toy vehicle travels along the exterior surface of the second segment.

17. The toy track set as in claim 16, further comprising another portion releasably secured to the second segment and wherein the first portion of the second segment has a trigger for releasing the another portion from the second segment, wherein the trigger is positioned on a surface of the first portion such that when the toy vehicle travels along the surface of the first portion the trigger is actuated and the another portion is released from the second segment.

18. The toy track set as in claim 17, wherein the first segment of the second track path is configured to invert the toy vehicle prior to it traversing the gap.

19. The toy track set as in claim 17, wherein the another portion of the second segment also defines a portion of the receiving area and the surface of the first portion is an exterior surface of the second segment.

20. The toy track set as in claim 16, further comprising a motor for pivoting the second segment between its first position and its second position and wherein the track diverter is spring biased into its first position and wherein the motor rotates a cam configured to provide at least two different ranges of movement of the second segment as the second segment moves between its first position and its second position.

* * * * *